US006857507B2

(12) United States Patent
Gallati et al.

(10) Patent No.: US 6,857,507 B2
(45) Date of Patent: Feb. 22, 2005

(54) EQUIPMENT FOR FINE-POSITIONING AT LEAST ONE DECK OF A MULTI-DECK CAGE FOR A LIFT

(75) Inventors: Fabio Gallati, Ebikon (CH); Josef Schwarzentruber, Meggen (CH)

(73) Assignee: Inventio AG, Hergiswil (CH)

( * ) Notice: Subject to any disclaimer, the term of this patent is extended or adjusted under 35 U.S.C. 154(b) by 202 days.

(21) Appl. No.: 10/372,486

(22) Filed: Feb. 24, 2003

(65) Prior Publication Data

US 2003/0164266 A1 Sep. 4, 2003

(30) Foreign Application Priority Data

Mar. 4, 2002 (EP) ..... 02405164

(51) Int. Cl.[7] ..... B66B 1/42
(52) U.S. Cl. ..... 187/284
(58) Field of Search ..... 187/203, 216, 187/221, 225, 284, 291, 308, 314, 337, 401, 902

(56) References Cited

U.S. PATENT DOCUMENTS 5,960,910 A * 10/1999 Traktovenko ..... 187/401
6,334,511 B1 * 1/2002 Araki ..... 187/380
6,615,952 B2 * 9/2003 Itoh et al. ..... 187/249
6,786,305 B2 * 9/2004 Kamimura et al. ..... 187/314
6,802,396 B2 * 10/2004 Naitoh ..... 187/401
2004/0050628 A1 * 3/2004 Fujita et al. ..... 187/292

FOREIGN PATENT DOCUMENTS

GB 2143217 A * 2/1985 ..... B66B/17/10
JP 04072288 A * 3/1992 ..... B66B/11/02
JP 04303378 A * 10/1992 ..... B66B/1/14

* cited by examiner

*Primary Examiner*—Jonathan Salata
(74) *Attorney, Agent, or Firm*—Schweitzer Cornman Gross & Bondell LLP

(57) ABSTRACT

A multi-deck cage has a deck floor with a ramp drive for fine positioning. The deck floor is configured as a ramp rotatable about a rotary axle and is movable up and down by means of actuators of the ramp drive. A sensor, which locates a mark arranged at a story sill, is arranged at a deck sill which is constructed as part of the deck floor. If the sensor has, at a stopping of the multi-deck cage at the story, travelled past the mark, the ramp drive is activated in a direction opposite to the travel direction of the multi-deck cage past the story stop until the sensor and the mark are disposed at the same level.

7 Claims, 3 Drawing Sheets

EQUIPMENT FOR FINE-POSITIONING AT LEAST ONE DECK OF A MULTI-DECK CAGE FOR A LIFT

The invention relates to equipment for fine-positioning at least one deck of a multi-deck cage for a lift, wherein at least one deck positions its deck sill of the deck floor at the story level.

BACKGROUND OF THE INVENTION

A lift with a double-deck cage is known from WO 98/09906 in which the upper deck can be matched to the upper edge of the story to be served. The upper deck consists of a fixed platform and a vertically displaceable platform. Actuators supported on the fixed platform move the displaceable platform up and down until the upper platform is disposed flush with the upper edge of the story to be served, wherein positioning sensors control the movement of the platform. This allows both decks to be aligned with the respective stories.

A disadvantage of such known equipment resides in the fact that a movable platform driven at four corners can tilt. An offset can thereby arise between the platform and the story, which represents a significant risk of accident for boarding and alighting lift passengers.

BRIEF DESCRIPTIONS OF THE INVENTION

The present invention avoids the disadvantages of known equipment, and creates a multi-deck cage with at least one deck which can be matched to the story in a level manner and which allows a safe boarding and alighting for the lift passengers.

In accordance with the invention a multi-deck cage includes a deck floor configured as a ramp pivotable about a ramp axis and a ramp drive for raising and lowering the ramp. Sensor means are provided to determine correct alignment between an end deck sill portion of the deck floor and a story sill, and are operatively connected to the ramp drive to allow the ramp drive to raise or lower the deck floor until the deck sill is properly aligned with the story sill. The deck sill may include a door guide that compensates for deck floor positioning to maintain proper door operation irrespective of the actual position of the deck floor and sill.

The advantages achieved by the invention are substantially to be seen in that with the multi-deck cage according to the invention the performance capability of a multi-deck lift can be improved because the fine-positioning of the deck or decks can be undertaken in a shorter time. Moreover, the construction according to the invention is mechanically robust, which in turn has a positive effect on the reliability of the multi-deck cage in lift operation. Of further advantage is the fact that the floor is moved as a ramp, which can be operated by a smaller drive than that required when the floor is raised or lowered as a platform.

BRIEF DESCRIPTION OF THE DRAWINGS

The present invention will be explained in more detail in the following detailed description of a preferred, but nonetheless illustrative embodiment thereof, when considered in association with the accompanying figures, in which.

DETAILED DESCRIPTION OF THE INVENTION

Figure 1:
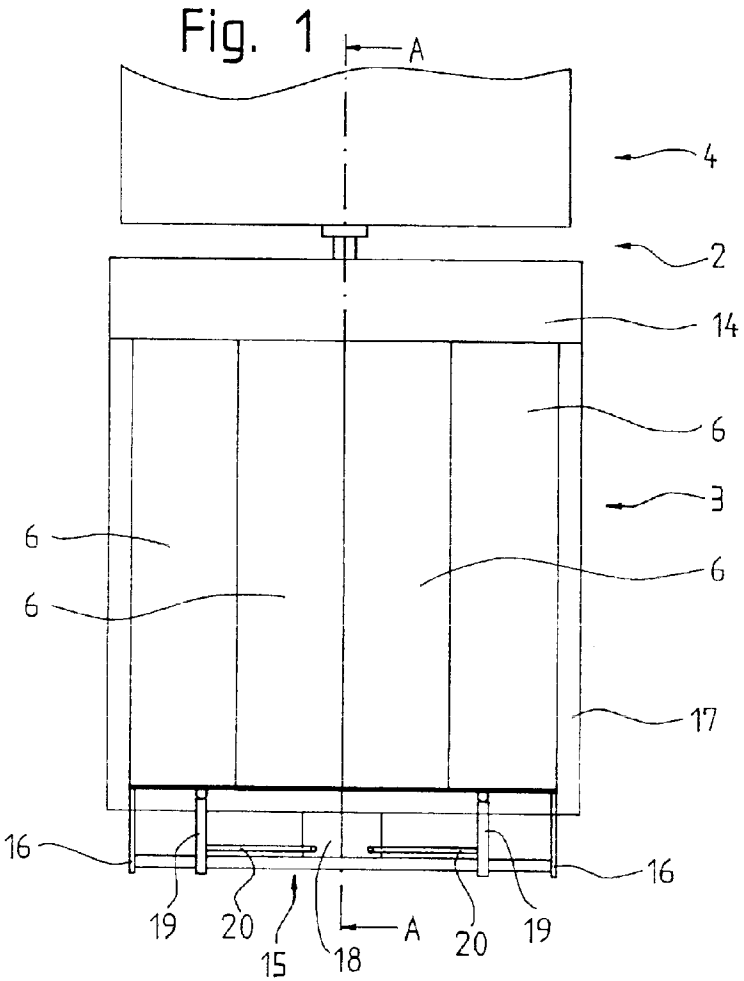
FIG. 1 is a diagrammatic view of a multi-deck cage having a lower deck with a ramp drive and an upper deck.
Figure 2:
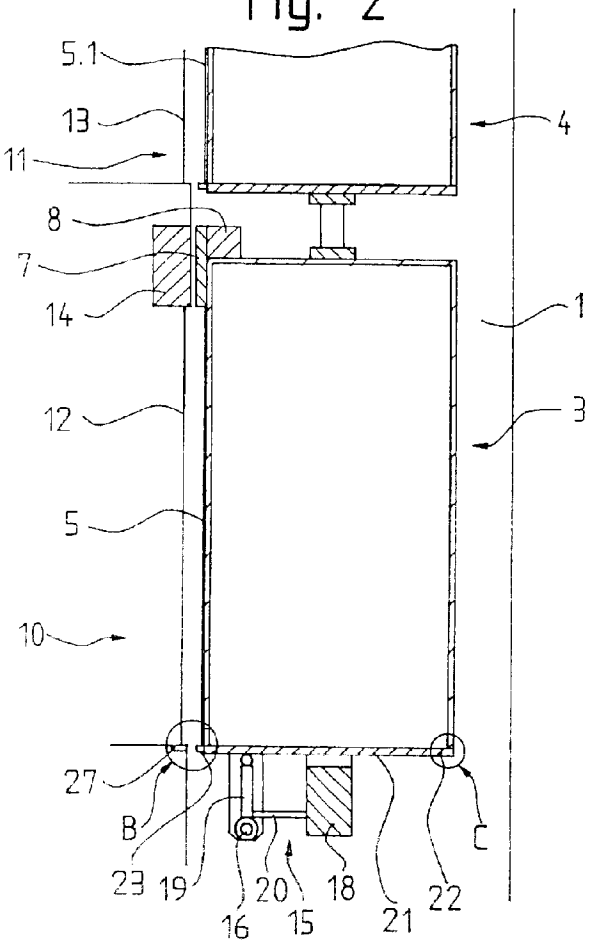
FIG. 2 shows a section along line A-A of FIG. 1 of the multi-deck cage in a lift shaft.

FIGS. 1 and 2 show a multi-deck cage 2 which is movable in a lift shaft 1 and comprises a lower deck 3 and an upper deck 4. The deck door 5, which may be constructed as a telescopic door and has several door leaves 6, is shown at the lower deck. The upper deck door is denoted by 5.1. The door leaves 6 are suspended and guided at the top at a door guide 7, wherein a door drive 8 moves the door leaves 6. The lift shaft 1 is formed from shaft walls, wherein a respective opening, which provides access to the multi-deck cage 2, is provided for each story. In FIG. 2 there is shown a first, uneven-number story 10 and a second, even number story 11. The respective openings in the shaft wall are closed by story door 12 and story door 13. The story door 12 is guided by a door guide arranged in a cross member 14 and moved by means of the lower story deck door 5. The story door 13 is similarly guided and moved by the upper story deck door 5.1.

The lower deck 3 is provided with a ramp drive 15 which is arranged below the deck 3 at a support construction 16. The support construction 16 is fixedly connected to a support frame 17 of the deck 3. The ramp drive 15 comprises a drive unit 18, which can be, for example, a hydraulic drive or a pneumatic drive, and actuators 19, which can be, for example, hydraulic cylinders or pneumatic cylinders, wherein the cylinders are connected to the drive unit 18 by way of lines 20. The deck floor 21 of lower deck 3, which is constructed as a ramp, can be raised or lowered by the actuators 19. Specific features with respect thereto are shown in the detail views of portions B and C of FIG. 2. Spindle drives acting as actuators 19 can also be provided as the ramp drive 15. Instead of the lower deck 3, the upper deck 4 can be equipped with a ramp drive 15 and a ramp. Alternatively, both decks 3, 4 can be equipped with a ramp drive 15 and a ramp.

Compensation for height deviations between the stories 11, 12 are provided by the floor 21, which is constructed as a ramp, wherein one deck 3 or 4 is levelled to be flush with the story and the other deck 3 or 4 is adjusted to the story level by means of the movable ramp. Which of deck 3 or 4 adjusts to the story level is dependent on whether the respective deck 3 or 4 serves only uneven-numbered stories or also even-numbered stories.

Figure 3:
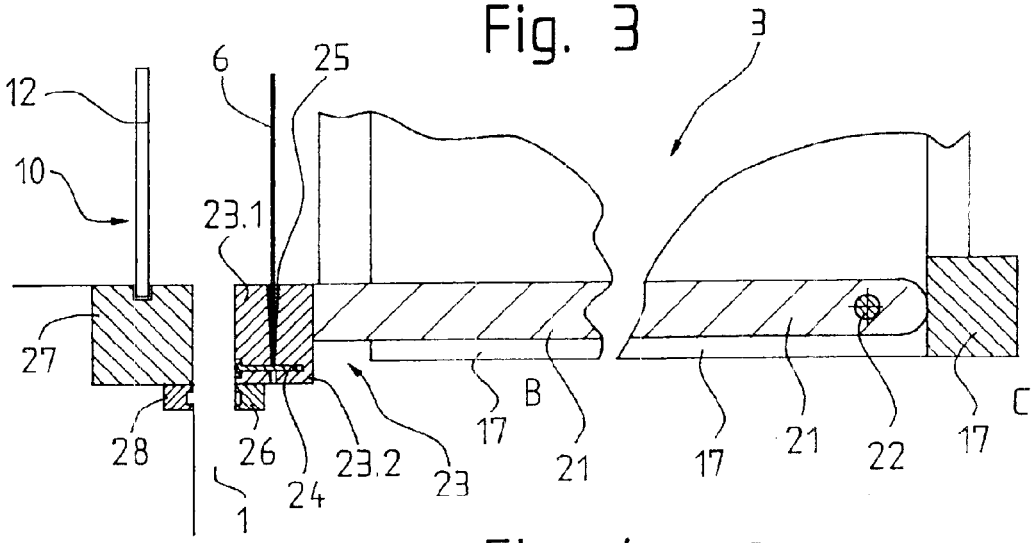
FIG. 3 is a detail view of portions B and C of the deck floor in FIG. 2, constructed as a ramp.

FIG. 3 shows the details B and C of FIG. 2. The deck floor 21 serving as a ramp is rotatably mounted about a ramp axis by means of a rotary axle 22, wherein the rotary axle 22 is connected at both ends to the support frame 17. At the other end of the deck floor 21 there is arranged a deck sill 23 which serves for the lower guidance of the deck door 5 and the door leaves 6. The deck sill 23 comprises a first half 23.1 and a second half 23.2, which are connected by means of screws 24, wherein the halves 23.1, 23.2 form a V-shaped slot 25 into which the deck door 5 extends and in which the deck door 5 is guided. The V-shaped slot 25 provides door compensation during raising and lowering of the deck floor 21, wherein guidance of the deck door 5 free of jamming is ensured irrespective of the position of the deck floor 25. A sensor 26, which locates a mark 28 arranged below a story sill 27, is arranged below the first half 23.1 of the deck sill 23 and is coupled to a lift control (not shown) of known construction. The sensor 26 and mark 28 can also be integrated into the sills 23, 27.

Figure 4:
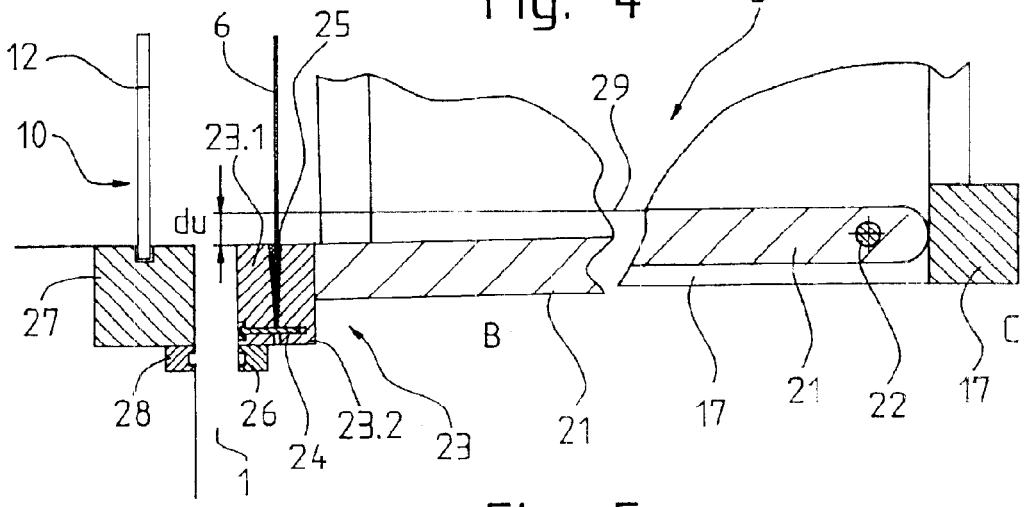
FIG. 4 is a detail view showing the ramp in a lowered setting for fine-positioning of the deck.
Figure 5:
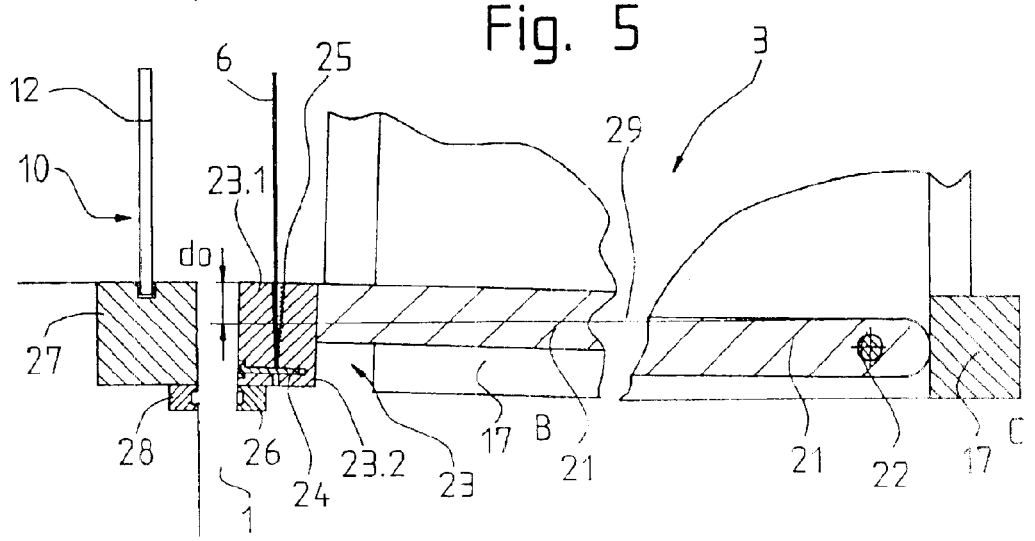
FIG. 5 is a detail view showing the ramp in a raised setting for fine-positioning of the deck.

FIG. 3 shows the deck floor 21 in the horizontal position 29. FIG. 4 shows the deck floor 21 deflected downwardly by the maximum distance du from the horizontal position 29. The lower end of the door leaf 6 extends less deeply into the V-shaped slot 25 approximately by the distance du. FIG. 5 shows the deck floor 21 deflected upwardly by the maximum distance do from the horizontal position 29. The lower end of the door leaf 6 extends more deeply into the V-shaped slot 25 approximately by the distance do. The maximum distances do, du can amount to a few centimeters.

The lift control recognizes the travel direction of the multi-deck cage 2. If the sensor 26, up to stopping of the multi-deck cage 2 at a story, has travelled past the mark 28 of the story sill 27, the ramp drive is activated in a direction opposite to the travel direction of the multi-deck cage 2 past the story stop until the sensor 26 and the mark 28 are disposed at the same level. If the sensor 26 up to stopping of the multi-deck cage 2 at the story has not recognized the mark 28 of the story sill 27, the ramp drive is activated in the travel direction of the multi-deck cage 2 to the story stop until the sensor 26 and the mark 28 are disposed at the same level.

A further variant relates to pre-adjustment of the story floor. The exact position of the story sill can be learned in a learning travel, for example through a shaft data system. The deck floor can be pre-adjusted by this data during the journey to the designated story to which movement is to take place. A precondition is, however, the presence of the necessary equipment (travel transmitter, travel regulator) for detecting and controlling the travel of the deck floor relative to the support frame of the multi-deck cage.

Figure 6:
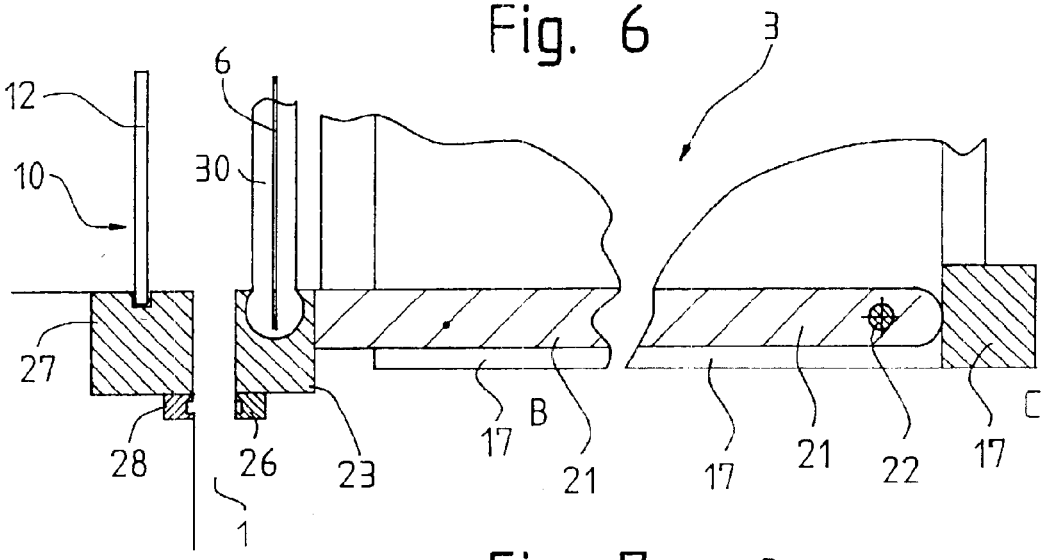
FIG. 6 is a detail view showing a second embodiment of the deck sill movable with the ramp.
Figure 7:
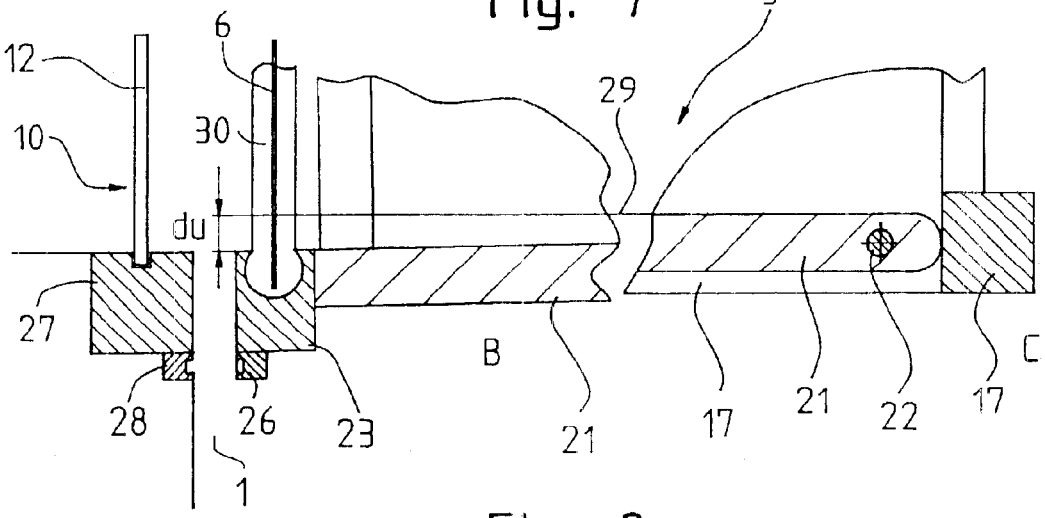
FIG. 7 is a detail view showing the ramp with the deck sill according to FIG. 6 in a lowered setting for fine-positioning of the deck.
Figure 8:
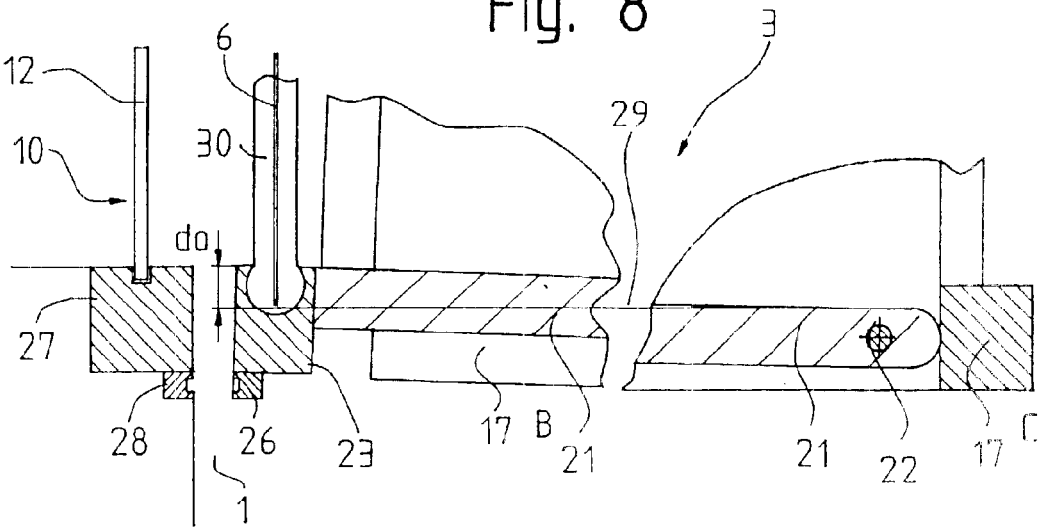
FIG. 8 is a detail view showing the ramp with the deck sill according to FIG. 6 in a raised setting for fine-positioning of the deck.

FIGS. 6 to 8 show a further embodiment of the deck sill 23. A sliding guide shoe 30 is connected with the deck sill 23 and guides the door leaf 6 in the vertical direction. The sliding guide shoe 30 has a circular degree of freedom and can compensate, by its cylindrical foot, for the movement of the deck sill 23 relative to the door leaf 6. FIG. 6 shows the deck floor 21 in the horizontal position 29. FIG. 7 shows the deck floor 21 deflected downwardly by the maximum distance du from the horizontal position 29. The lower end of the door leaf 6 extends less deeply into the sliding guide shoe 30 by approximately the distance du. FIG. 8 shows the deck floor 21 deflected upwardly by the maximum distance do from the horizontal position 29. The lower end of the door leaf 6 extends more deeply into the sliding guide shoe 30 approximately by the distance do.

FIGS. 1 to 8 show a ramp for fine-positioning of the deck of a multi-deck cage, wherein the ramp is formed by the entire deck floor 21. In a further embodiment, the ramp can be formed from a part of the deck floor, for example the sill region of the deck floor.

We claim:

1. Equipment for fine-positioning at least one deck of a multi-deck cage for a lift, wherein a deck sill of a deck floor is to be positioned at a story level, characterized in that the deck floor is a pivoting ramp having means to align the deck sill at the story level.

2. The equipment according to claim 1, characterized in that the deck floor is pivotable by means of a ramp drive about a rotary axle.

3. The equipment according to claim 2, characterized in that the rotary axle is disposed opposite the deck sill, wherein the ramp drive has actuators to align the deck sill at the story level.

4. The equipment according to claim 2 or 3, characterized in that the deck sill has a V-shaped slot, wherein the V-shaped slot serves as a compensating guide for a deck door when the deck sill is pivoted.

5. The equipment according to claim 2 or 3, characterized in that the deck sill comprises a sliding guide shoe having a cylindrical foot with a circular degree of freedom, wherein the sliding guide shoe compensates for movement of the deck sill relative to a deck door.

6. The equipment according to claim 1, 2 or 3, wherein the alignment means comprises a sensor arranged at the deck and a mark arranged at the story level, wherein the ramp drive includes means for moving the ramp up or down until the sensor locates the mark.

7. The equipment according to claim 1, 2 or 3, characterized in that a device for detection and control of the travel of the ramp relative to the support frame of the multi-deck cage is provided, wherein the fine-positioning of the deck floor is carried out during travel of the multi-deck cage to the story level on the basis of story distances known beforehand.

* * * * *